US005095797A

United States Patent [19]

Zacaroli

[11] Patent Number: 5,095,797

[45] Date of Patent: Mar. 17, 1992

[54] AUTOMATIC TONE CONTROL FOR STRINGED MUSICAL INSTRUMENTS

[76] Inventor: Edward C. Zacaroli, 122 Arlington Rd., Utica, N.Y. 13501

[21] Appl. No.: 629,446

[22] Filed: Dec. 18, 1990

[51] Int. Cl.[5] ..... G10G 7/02

[52] U.S. Cl. ..... 84/455; 84/DIG. 18

[58] Field of Search ..... 84/454, 455, DIG. 18, 84/200, DIG. 24; 74/470

[56] References Cited

U.S. PATENT DOCUMENTS

| | | | |
|---|---|---|---|
| 2,624,027 | 12/1952 | Clark | 318/29 |
| 4,375,180 | 3/1983 | Scholz | 84/454 |
| 4,426,907 | 1/1984 | Scholz | 84/454 |
| 4,453,448 | 6/1984 | Miesak | 84/454 |
| 4,803,908 | 2/1989 | Skinn et al. | 84/454 |
| 4,829,843 | 5/1989 | Suzuki | 74/470 |
| 4,909,126 | 3/1990 | Skinn et al. | 84/454 |
| 4,928,563 | 5/1990 | Murata et al. | 84/454 X |

*Primary Examiner*—Russell E. Adams
*Assistant Examiner*—Jae N. Noh
*Attorney, Agent, or Firm*—Wall and Roehrig

[57] ABSTRACT

Automatic tuning control arrangement for a string musical instrument, such as a guitar, has a pivoted tone arm with a hook at one end for attaching to an associated one of the guitar strings, and a shape memory metal wire tension motor extending between the tone arm and an anchor point on the instrument to rock the tone arm in opposition to the tension of the musical string. A strain sensor, such as a strain gauge, is mounted on the tone arm and it is electrically coupled to a control circuit that supplies a control current to the shape memory metal wire in the traction motor. A biasing spring can also be coupled between the tone arm and a bias anchor on the instrument to apply a spring bias in opposition to the musical string tension. As the guitar string or other string stretches over time, the traction motor will rock the tone arm to take up the slack and maintain an even tension on the string, thus keeping the string in tune. On the other hand, the shape memory metal alloy prevents resonance from occurring in the tone arm or biased spring, so that the musical notes played on the instrument maintain their original crispness and richness.

15 Claims, 3 Drawing Sheets

AUTOMATIC TONE CONTROL FOR STRINGED MUSICAL INSTRUMENTS

BACKGROUND OF THE INVENTION

The present invention relates to automatic tuning devices for stringed instruments, i.e., fretted instruments such as guitars, and banjos or bowed instruments such as violins, cellos, or double basses. Instruments of these types rely for the pitch of their musical notes on the tension of the several musical strings that run from the body along a fingerboard to a head where the strings are attached to respective tuning pegs. It is the nature of the strings to stretch somewhat over time, especially while the instrument is being played. Stretching of the strings causes the tension to reduce, so that the instrument goes flat after a short time.

A number of proposals for automatic tuning devices appear in the literature, but these have not been widely accepted. Clark U.S. Pat. No. 2,624,027 employs a motor control system to tension a vibrating filament. Scholz U.S. Pats. Nos. 4,375,180 and 4,426,907 describe an automatic self-tuning device for guitars, using electrical contacts that make or break to energize an electric motor that controls the string tension. Skinn et al. U.S. Pat. No. 4,803,908 describes a digital tuning system in which each string of a guitar has an associated tuning arm and stepper motor. A transducer senses the pitch of the vibrating strings and adjusts the string tensions accordingly. Murata et al. U.S. Pat. No. 4,928,563 relates to an electronic tuning apparatus for electric guitars in which pitch information is extracted from the instrument during playing, and a small motor is energized for each string to adjust the string tension.

An unfortunate characteristic of stringed instruments is that the strings have to re-tuned continually in order for them to maintain their pitches. How often retuning is necessary varies widely from one instrument to the next, but as a rule guitar players have to retune after playing a maximum of about six or seven selections. This is quite inconvenient, especially for performing musicians. This is even more of a problem for rock guitarists who, by the nature of their music, require more retuning of their instruments than normal. In fact, it is common practice for a rock guitarist to have several "in-tune" instruments on hand for a concert, and to quickly change the instrument when the instrument in use goes out of tune. This practice requires an assistant to constantly retune the spare instruments on stage during a concert.

Quite clearly, it has long been desired for guitarists and other instrumentalists to play instruments that maintain their pitch over a long period of time, and preferably over the entire lifetime of the string. On the other hand, any automatic tuning device should not affect the purity, richness, tone, and crispness of the sound of the instrument, which can degrade if an active electromechanical device is connected to the strings.

OBJECTS AND SUMMARY OF THE INVENTION:

It is an object of this invention to provide an automatic tone control arrangement for a guitar or other string instrument which maintains the tension on the string over time, but which does not adversely affect the musical tone of the instrument.

Another object is to provide an automatic tone control arrangement of extremely simple design, with a minimum of moving parts.

Shape memory alloy is a key to the success of this invention. These metal alloys have a unique crystal structure that changes shape radically when subjected to temperature change. The shape changes occurs over a very small temperature range (20 to 30 degrees C.), rather than continuously over a wide temperature range as in more traditional metals.

These metals alloys can be formed into wires which can be quickly heated electrically but which are quickly cooled as well. These wires have significant strain recovery forces which permit them to be made into small motors that can do useful work over very small temperature ranges. Thus, shape memory metal wires can be combined with suitable controlled heating current sources to form a linear traction motor. Memory metal alloy devices are employed, e.g., as electromechanical actuators for opening dampers, valves, etc., and can be employed also as fuses or circuit breakers.

A characteristic of the shape memory alloy wire that is significant for the present invention is that it has a hysteresis characteristic that prevents it from resonating with the vibrating string to which it is coupled. The shape memory alloy prevents any resonating from occurring, so the tuning device does not rob the instrument of its crispness or richness of tone.

On the other hand, if a spring or electromechanical device (i.e., stepper motor) is employed in an attempt to bias the tension of the musical string, the effect would be for the spring or other device to resonate with the string, and cause a cancellation of some of the natural vibrations (usually most of the overtones) of the vibrating spring. This results in a flat sound. For this reason it should be no surprise that musicians have resisted previous attempts at automatic tuning device.

According to an aspect of this invention, a tone control or tuning control device is provided for a stringed musical instrument in which at least one string is supported under tension, and where the open or unfingered pitch of the string depends mainly on the tension applied to it. For each string there is a separate mechanism, as each string tension should be controlled independently. A pivoted tone arm is provided for each string with one end of the string being attached to one end of the tone arm. A pivot mounts the tone arm on the instrument to rock in a direction to affect the tension on the string. A bias spring is connected to a point between the pivot and the other end of the tone arm and is also connected to a bias anchor on the instrument. This is positioned to have a lever arm relative to the vibrating string for example between 1:1 and 3:1, while the lever arm of the shape memory wire traction motor relative to the tensioned string can be on the order of about six to one. In some cases, the bias spring can be omitted.

A strain sensor and control circuit serve as a feedback or servo to control the tension imposed by the shape alloy wire. The strain sensor can include a strain gauge seated in a reduced-thickness flex portion of the tone arm, which is preferably located between the point where the traction motor is connected to the tone arm to the point where the bias spring is connected to the tone arm. This strain gauge provides an output that is supplied to control a current supply which is in turn coupled to the shape memory alloy traction motor. In a version of this system, the circuit has one input coupled to the strain gauge and another coupled to a variable resistor. This permits the pitch of the string to be changed simply by changing the slider position of the variable resistor. This feature can be used for tuning the guitar or other instrument, or for tremolo, note-bending or other musical techniques.

The memory metal alloy can be BioMetal (TM) or any other suitable alloy, such as Nitinol, nickel-titanium, or the like.

The above and many other objects, features, and advantages will become apparent to those skilled in the art from a reading of the ensuing detailed description of preferred embodiments, to be read in conjunction with the accompanying Drawing.

DETAILED DESCRIPTION OF THE PREFERRED EMBODIMENTS

Figure 1:
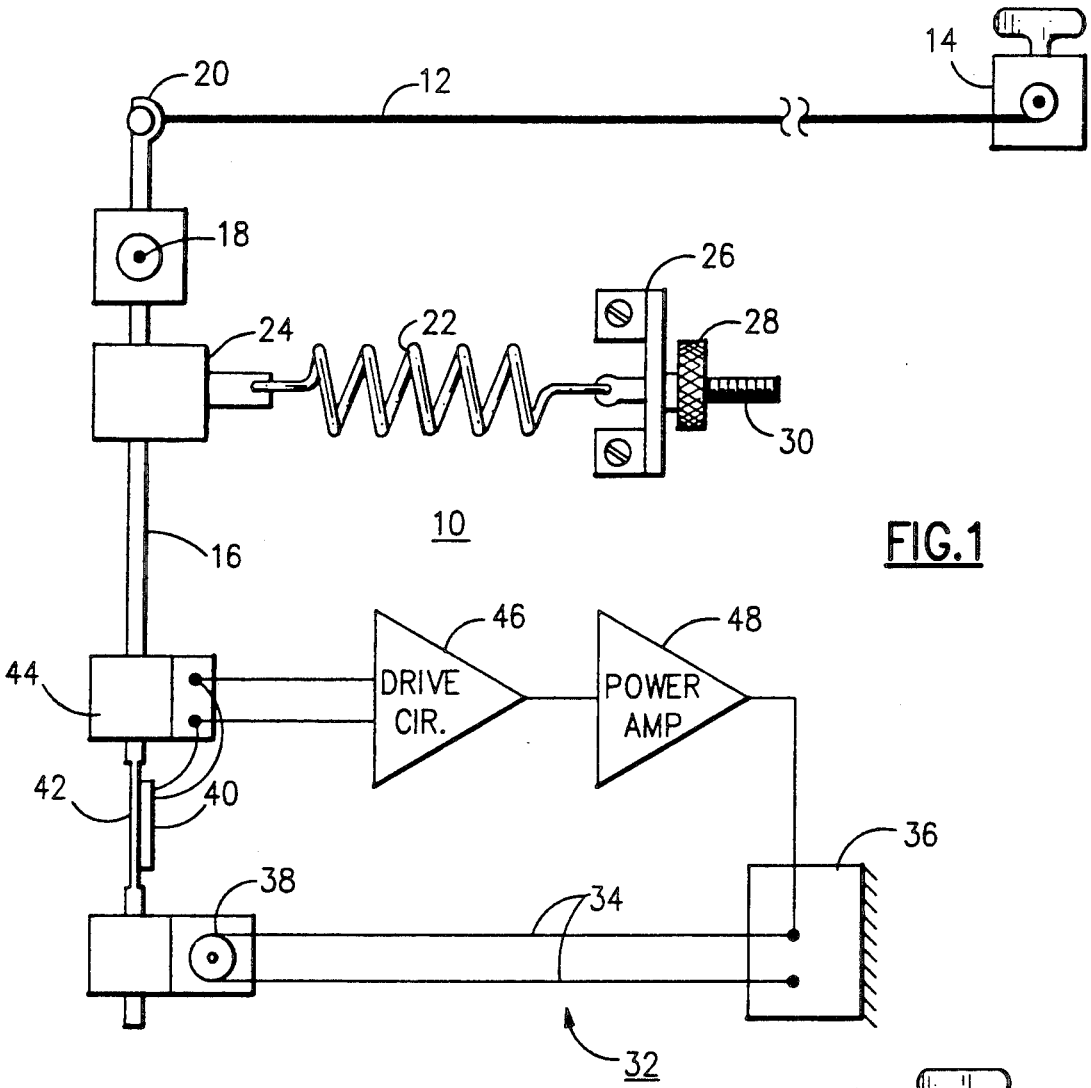
FIG. 1 is a schematic diagram of an automatic tension control arrangement according to an embodiment of this invention.

With reference to the Drawing, and initially to FIG. 1, an automatic string tension control arrangement 10 is illustrated in connection with one end of a vibrating musical string 12, such as a guitar string. The other end of the string 12 is wrapped onto a conventional tuning peg 14, which is adjusted initially to tension the string 12 until its open or unfingered musical pitch is at a desired frequency.

A tone arm 16 is rockably mounted about a pivot pin 18 onto the musical instrument. There is a hook 20 at a first end of the tone arm 16 into which one end of the spring 12 is received. A bias spring 22 is coupled by means of an attachment 24 to the tone arm 16 on the side opposite the hook 20. The spring 22 is also coupled to a bias anchor 26 affixed onto the musical instrument to hold the spring 22 under tension that opposes the tension in the string 12. An adjustment nut 28 and an associated adjustment screw 30 permit adjustment of the spring tension by the musician. In this case, the lever arms from the pivot pin 18 to the hook 20 and from the pivot pin 18 to the bias spring attachment 24 is a ratio of 1:1 to 3:1.

The tone arm 16 continues beyond the spring attachment 24 to a distal end at which there is attached a shape memory alloy wire traction motor 32. This motor 32 is formed of a shape memory alloy wire of small diameter formed into one or more strands 34. In this case, the wire is bent into two strands and extends from an anchor block 36 that is fixed with respect to the instrument, over a pulley 38 mounted on the end of the tone arm 16, and back to the anchor block 36. A strain gauge 40 is mounted onto a reduced thickness zone 42 on the tone arm 16, this zone being between the pulley 38 and the bias spring attachment 34. The reduced thickness zone 42 is more flexible than the remainder of the arm 16, and thus the strain gauge 40 is particularly sensitive to changes in the opposing tension forces applied by the string 12 and by the traction motor 32.

Leads from the strain gauge 40 attach to a terminal block 44, and from there supply a strain sensor signal to a drive circuit 46, whose output is fed through a power amplifier 48 to terminals mounted on the anchor block 36. The output of the power amplifier 48 thus serves as a heater current for heating the memory metal alloy wire strands 34, thus causing the motor 32 to change its traction characteristic in response to tension changes as signaled by the strain gauge 40.

In this case, the portion of the tone arm 16 that extends from the pivot pin 18 to the pulley 38 forms a lever arm that is about six times the length of the lever arm from the pivot pin 18 to the hook 20.

The shape memory alloy in the wire strands 34 has a significant hysteresis factor, and thus absorbs any resonance from the vibrating string 12. This prevents the spring 22 from resonating, and thereby prevents the tone control arrangement 10 from robbing the vibrating string of overtones. Thus, with this invention, the musical instruments retain all their original character and brilliance, and yet remain in tune by action of the shape memory alloy wire traction motor.

Figure 2:
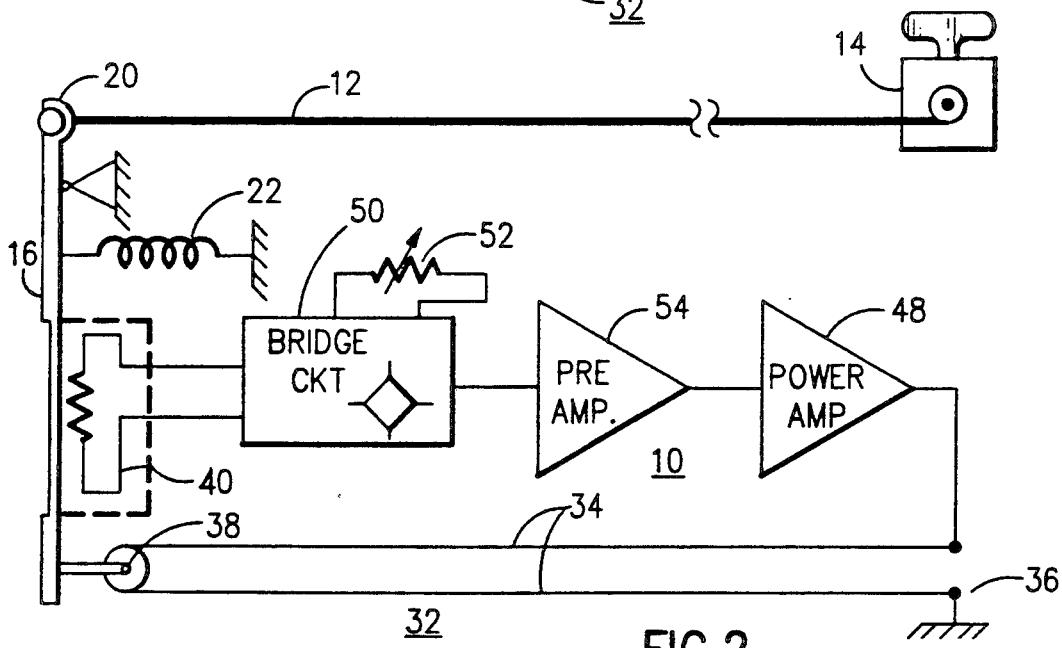
FIG. 2 is a schematic diagram of an alternative automatic tension control arrangement of this invention.

A similar automatic tone control arrangement is shown schematically in FIG. 2. Here, elements that are shown and described with reference to FIG. 1 are identified with the same reference numbers, and a detailed description thereof is not repeated.

In this embodiment, the drive circuit comprises a bridge circuit 50, in which one leg is formed of the strain gauge 40, another leg is formed of a variable resistance 52. The balance of the bridge is adjusted by adjusting a slider on the variable resistance 52, and an output of the bridge circuit is supplied through a preamplifier 54, and thence through power amplifier 48 into the strands 34 of the shape memory alloy wire motor 32. Thus, by adjusting the slider position of the resistor 52, the pitch of the string 12 can be quickly adjusted. A separate adjustment can thus be provided for each string of the instrument, or the variable resistors can all be ganged together and controlled by a common control device, e.g., by a tremolo bar. Thus, the circuit of FIG. 2 facilitates tremolo, tone bending, or other musical techniques in which the musical pitch is varied during play.

Figure 3:
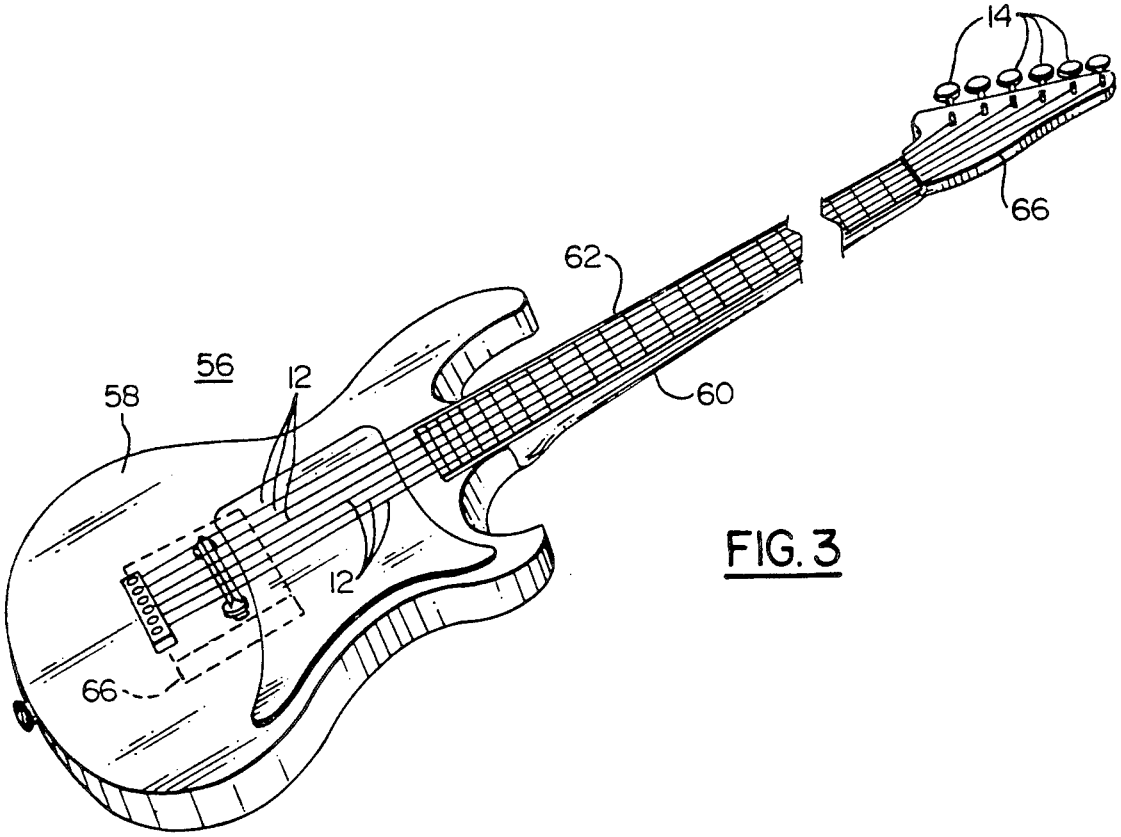
FIG. 3 is shows an electric guitar incorporating automatic guitar string tension control according to an embodiment of this invention.

FIG. 3 shows an electric guitar 56 which can incorporate the automatic tuning or tension control arrangement of this invention. The guitar 56 has a guitar body 58, which can be hollow or solid, and a neck 60 that extends from one side of the body. A fingerboard 62, which contains frets at predetermined positions, is carried on one side of the neck 60. A head 64 is shown at the end of the neck 60, here with six tuning pegs. There are six guitar strings 12 that extend in parallel across the body and along the neck adjacent the fingerboard 62 to the head 64 where they are attached to respective ones of the tuning pegs.

In this guitar 56 there is an automatic tuning control arrangement 66 incorporated into the body 58 of the guitar. This tuning control arrangement 66 independently maintains the tension on each of the six strings. This arrangement is shown in more detail in FIGS. 4 and 5.

Figure 4:
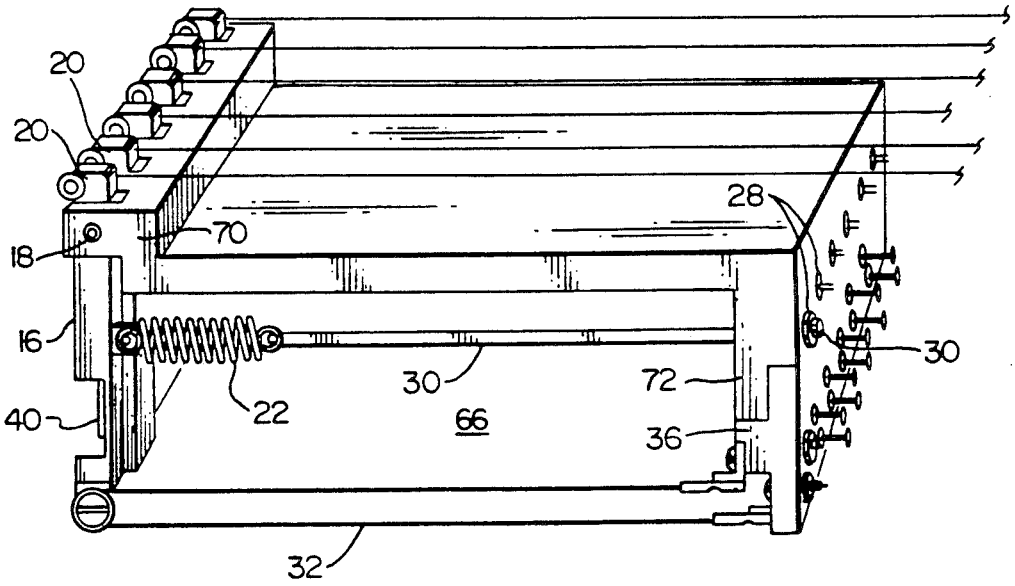
FIG. 4 is a perspective view of the guitar string tension control employed in the guitar shown in FIG. 3.

As shown, e.g., in FIG. 4, the arrangement 66 has a frame 68 with a pivot plate 70 having receptacles for mounting six tone arms 16, i.e., one for each of the six strings. Here, the six tone arms 16 are mounted by means of a single or a common pivot pin 18. A back plate 72 is vertically attached to a distal end of the pivot plate 70, and serves as an anchor point for the respective bias springs 22 and also for the anchor blocks 36 of the respective shape memory alloy wire traction motors 32 that are each associated with a respective one of the tone arms 16. In this case, only a typical one of the springs 22 and of the traction motors 32 is shown, to reduce drawing clutter. However, the spring bias adjusting screws 30 and adjustment nuts 28 are shown for each of the six springs 22, and anchor blocks 36 which are embedded into the back plate 72 are shown for each of the six traction motors 32. While not specifically shown in FIGS. 4 and 5, there is a circuit board containing a suitable power supply and respective drive circuits 46 and power amplifiers 48 for each of the shape memory alloy wire traction motors 32. Such circuit board could be mounted, e.g., on one surface of the back plate 72

Figure 5:
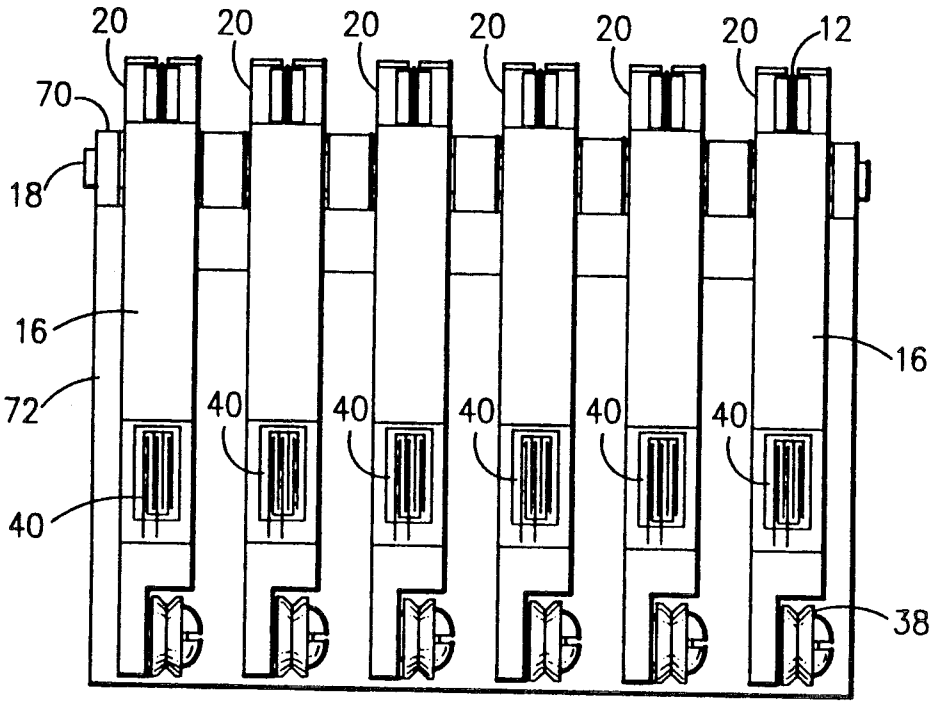
FIG. 5 is an end view taken at line 5—5 of FIG. 4.

In the embodiment shown in FIGS. 4 and 5, the mechanical advantage of approximately 6:1 for of the traction motor 32 relative to the hook 20 and guitar string 12, is maintained, and the bias spring mechanical advantage is about 3:1 as described previously. However, the length of the tone arm 16 can be significantly shortened, with correspondingly increase in the mechanical advantage of the traction motor 32, for example, by employing additional pulleys.

It should be recognized that with this invention there are several advantages that were not previously available.

For example, in a band or orchestra, where there is a requirement for all string instruments to be at the same pitch, this requirement can be satisfied for an entire performance without need for retuning between selections.

When transporting a stringed instrument in cold weather, it is usually required for the instrument to slowly warm up to room temperature before a practice or performance because the strings will not hold their proper pitch when the instrument is first brought into a warm room. However, with this invention this problem is entirely eliminated.

In a concert setting, and more specifically in concerts in which electric guitars are employed, such as with rock bands, an artist is often required to perform for two hours or more continuously. Accordingly, many guitarists have developed the practice of switching among several different guitars during the concert while a technician retunes the guitars. With this invention, the requirement for retuning and for keeping several guitars on hand is avoided. On the other hand, if the instrumentalist chooses to use a number of different guitars during a performance to achieve different sounds, he or she can do so knowing that any of the guitars that are chosen will be properly tuned and will stay in tune.

Additionally, with this invention, a beginner or novice learning to play a string instrument can concentrate entirely on finger position and technique, without concerning himself or herself about whether the instrument is out of tune or about retuning the instrument without proper supervision.

While this invention has been described in detail with reference to selected preferred embodiments, it should be understood that the invention is not limited to those precise embodiments. Rather, many modifications and variations would present themselves to those of skill in the art without departing from the scope and spirit of this invention, as defined in the appended claims.

What is claimed is:

1. Automatic tension control arrangement for a stringed musical instrument in which there is at least one musical string supported thereon under suitable tension, and which has a musical pitch that is a function of the tension applied thereto; the tension control arrangement comprising a pivoted tone arm having means at one end for attaching to an end of an associated musical string; a pivot for mounting said tone arm on said instrument to rock in a direction to affect the tension on said string; a shape memory metal alloy wire traction motor mounted between an anchor point on said tone arm and an anchor point on said instrument to rock said tone arm in opposition to the tension of said musical string, the shape memory metal alloy wire traction motor including a shape memory alloy wire formed into one or more strands which extend straight between said anchor points on said instrument and on said tone arm; strain sensor means on said tone arm for sensing strain on said arm that results from the tension of said string and traction of said traction motor; and a circuit having an input coupled to said strain sensor means and an output connected to said wire of said shape memory metal alloy wire traction motor for delivering thereto a drive current at a value that varies as a function of said strain, thus causing said traction motor to rock said tone arm and maintain the string tension constant on said musical string.

2. Automatic tension control arrangement according to claim 1 further comprising resilient biasing means coupled between said tone arm and a bias anchor on the instrument for applying a spring bias in opposition to the musical string tension.

3. Automatic tension control arrangement according to claim 2 wherein said resilient biasing means includes a coil spring connected at one end to a bias spring anchor point on said tone arm, and threaded adjustment means connecting another end of said spring to said bias anchor.

4. Automatic tension control arrangement according to claim 3 wherein the bias spring anchor point on the tone arm at which the coil spring is connected is substantially the same distance from said pivot as is the means at the one end and at which the string is attached.

5. Automatic tension control arrangement according to claim 4 wherein said traction motor is connected to said tone arm at a second end thereof, the bias spring anchor point is disposed between said second end and said pivot, and the strain sensor means is positioned between said second end said bias spring anchor point.

6. Automatic tension control arrangement according to claim 5 wherein said strain sensor means is positioned in a recessed flex portion of the tone arm.

7. Automatic tension control arrangement according to claim 1 wherein said traction motor includes a wire formed of a shape memory metal alloy which shortens when heated, the wire having a first strand that is attached to an anchor member affixed with respect to said instrument, a portion passing over a pulley attached to said tone arm, and a second strand which is connected to said anchor member.

8. A stringed musical instrument of the type having a body, a neck projecting out from one side of the body and including a fingerboard on one side of the neck; a head supported on a distal end of the neck and including a plurality of tuning pegs; a plurality of musical strings which extend side by side from first ends attached to said body, along said fingerboard to the neck, and having second ends that are coupled to respective ones of said tuning pegs, and a tuning control device in said body supporting said first ends of the string and maintaining a desired tension in each of said strings so that the strings are held in tune; and comprising the improvement in which the automatic tuning control device includes a plurality of pivoted tone arms each having means at one end for attaching to the first end of a respective string; pivot means mounting said tone arms in said instrument body to rock in a direction to affect the tension on the strings; a plurality of shape memory metal wire traction motors mounted between the respective tone arms and anchor points on said body, the shape memory metal alloy wire traction motors each including a shape memory alloy wire formed into one or more strands which extend straight between said anchor points respectively on said instrument and on the associated tone arm; respective strain sensor means on said tone arms to sense strain imposed thereon from tension on said strings and from the associated traction motors; circuitry having inputs connected to said strain sensor means and respective outputs each connected to an associated one of said shape memory metal wire traction motors to deliver a drive current thereto at a value that varies in accordance with the tension on the associated musical string, thus causing the shape memory wire tension motors to rock the respective tone arms and maintain the string tension substantially constant.

9. String musical instrument according to claim 8 further comprising a plurality of resilient biasing members each coupled between a position on one of the tone arms and a bias anchor on the instrument for applying to the tone arm a bias force in opposition to the musical string tension.

10. Stringed musical instrument according to claim 9, wherein each said traction motor includes at least one strand of wire formed of a shape memory metal alloy which shortens when heated, and which is anchored at one end thereof to associated anchor points, and means on the associated tone arm coupling said at least one strand to the tone arm to apply tension thereto; and means connecting to said associated output of said circuitry to apply a control current onto said at least one strand.

11. Stringed musical instruments according to claim 9 wherein each said strain sensor means includes a strain gauge element positioned in a reduced-thickness portion of the associated tone arm between each said biasing member and said shape memory metal wire traction motor.

12. Automatic tuning control arrangement for a stringed instrument in which there is at least one musical string supported thereon under suitable tension and which has a musical pitch that is a function of the tension applied thereto; the tuning control arrangement comprising a pivoted tone arm having means at one end thereof for attaching to an end of an associated musical string; a pivot for mounting said tone arm on said instrument to rock in a direction to affect the tension on said string; a shape memory metal wire traction motor mounted between said tone arm and an anchor point on said instrument to rock said tone arm in opposition to the tension of said musical string, the shape memory metal wire traction motor including a shape memory alloy wire formed into one or more strands which extend straight between said anchor points on said instrument and on said tone arm; strain sensor means on said tone arm for sensing strain imposed on said arm from the opposing action of said musical string and said traction motor; and a circuit having an input coupled to said strain sensor means, an output connected to drive said shape memory wire traction motor for delivering a drive current thereto to control the action of the traction motor, causing said shape memory wire traction motor to rock said tone arm to maintain a desired string tension on said string, and adjusting the output drive current to alter said string tension.

13. Automatic tuning control arrangement according to claim 12 wherein said circuit means includes a bridge circuit having said strain sensor means connected in one leg thereof, said adjustable means includes a variable resistor connected in a second leg of the bridge circuit, and output means providing said drive current to said traction motor.

14. Automatic tuning control arrangement according to claim 12 further comprising resilient biasing means coupled between said tone arm and a bias anchor on said instrument for applying a spring bias in opposition to the musical string tension.

15. Automatic tuning control arrangement according to claim 12 wherein said strain sensor means includes a strain gauge positioned in a reduced thickness portion of said tone arm between said pivot and the point on said tone arm at which the traction motor is attached.

* * * * *